US007614510B2

(12) United States Patent
Williquette

(10) Patent No.: US 7,614,510 B2
(45) Date of Patent: Nov. 10, 2009

(54) POINT OF PURCHASE DISPLAY

(75) Inventor: Jeffrey G. Williquette, Neenah, WI (US)

(73) Assignee: WS Packaging Group, Inc., Algoma, WI (US)

( * ) Notice: Subject to any disclaimer, the term of this patent is extended or adjusted under 35 U.S.C. 154(b) by 0 days.

(21) Appl. No.: 12/341,518

(22) Filed: Dec. 22, 2008

(65) Prior Publication Data

US 2009/0101612 A1 Apr. 23, 2009

Related U.S. Application Data

(62) Division of application No. 10/882,372, filed on Jul. 1, 2004, now Pat. No. 7,467,720.

(60) Provisional application No. 60/485,328, filed on Jul. 7, 2003.

(51) Int. Cl.
*A47F 5/08* (2006.01)

(52) U.S. Cl. ..... 211/113

(58) Field of Classification Search ..... 211/113, 211/13.1, 85.3; 248/214, 317, 324; 206/806; 40/642.01, 124; 220/476; 24/30.5 P, 30.5 R, 24/16 PB See application file for complete search history.

(56) References Cited

U.S. PATENT DOCUMENTS 2,077,316 A 4/1937 Geib
2,492,226 A * 12/1949 Kohl et al. ..... 211/85.3
2,598,492 A 5/1952 Boes
3,028,013 A 4/1962 Cotey
3,028,974 A 4/1962 Loeb
3,310,179 A * 3/1967 Cappuzzello ..... 211/113
3,931,948 A * 1/1976 Mason, Jr. ..... 248/318
3,945,500 A 3/1976 Meckstroth
4,765,467 A * 8/1988 Kolton et al. ..... 206/296
D309,252 S 7/1990 Crowley
5,096,070 A 3/1992 Jaynes
5,386,916 A 2/1995 Valiulis
5,405,022 A 4/1995 Rissley
6,096,070 A 8/2000 Ragheb et al.
6,286,690 B1 9/2001 Thalenfeld

* cited by examiner

*Primary Examiner*—Jennifer E. Novosad
(74) *Attorney, Agent, or Firm*—Reinhart Boerner Van Deuren s.c.

(57) ABSTRACT

A point of purchase display includes a hanger strip with a plurality of sideways hangers suspending products with suspendable packaging. The hanger strip is a single planar sheet with a plurality of slits that form tongue members extending in one lateral direction to a free end that can be pivoted to either the front or back side of the strip. The tongues can take various configurations, for example, having upwardly extending hooked free ends or round-headed free ends. The hangers can also be formed of generally E-shaped slits defining opposing tongue and prong features, preferably designed to capture the necks of hanger hooks on the products. The hanger strip also has a display area devoid of hangers for promotional printing or decals.

20 Claims, 5 Drawing Sheets

POINT OF PURCHASE DISPLAY

IDENTIFICATION OF RELATED APPLICATIONS

This patent application is a division of U.S. patent application Ser. No. 10/882,372, filed on Jul. 1, 2004 now U.S. Pat. No. 7,467,720, entitled "Product Display Hanger Strip," which patent application is assigned to the assignee of the present invention, and which patent application claimed priority of U.S. Provisional Patent Application No. 60/485,328, which is entitled "Product Display Hanger Strip," and which was filed on Jul. 7, 2003, both of which patent applications are hereby incorporated herein by reference in their entirety.

BACKGROUND OF THE INVENTION

Field of the Invention

This invention relates to product displays and in particular to product hanging strips.

Product manufacturers and suppliers want their products displayed in prominent locations in an eye-catching manner likely to attract consumers. Retail outlets typically wish to maximize the quantity of products displayed for sale, and thus, premium shelf and floor space is limited. One way to increase the available space for display of certain products in high traffic areas, such as aisle end caps and check out lanes, is to attach the products to display strips. Such strips typically mount to the front of a shelf and sometimes project out into the aisle to make them more visible.

One example of a product display strip can be found in U.S. Pat. No. 6,286,690. This display strip includes a vertical support that mounts to the front of shelving and holds a wire bracket suspending a metal strip. The strip has a number of vertically spaced tabs or tongues cut out at all but one side on which the products are hung. Each tongue is bent at an angle away from the strip so that products can hang on the strip by simply slipping the tongue in a slot formed in the product package. The display strip disclosed in this patent is typical of many conventional displays, requiring separate mounting hardware and having connecting tabs or tongues that are oriented vertically in the direction of elongation of the strip. The tongues are in this orientation so that the attached products cannot readily fall from the strip. However, this is only true when the strip is in its proper vertical orientation. When it is tipped forward or sideways the products can fall off of the strip. Moreover, when the tongues are oriented this way, the products must be lifted up and slid off of the tongues, which is likely to dislodge one or more products suspended above the selected product, since it is customary to overlap adjacent products mounted on such strips.

Thus, a product display strip is desired with an improved connection for attaching the products being displayed.

SUMMARY OF THE INVENTION

In one aspect the invention provides a product display hanger strip comprising a single planar sheet extending from a top end to a bottom end and having a plurality of slits defining a plurality of hangers. Each hanger has a tongue extending laterally essentially perpendicular to the direction between the top and bottom ends and being separated from the sheet at a free end so the tongue can be pivoted with respect to the sheet.

In one preferred form, the slits defining the hangers take a continuous generally "E" shaped path. Each slit forms two prongs extending laterally in the opposite direction above and below the associated tongue. The prongs thus define a groove for the tongue. Like the tongue, the prongs are separated from the sheet at free ends so that they can be pivoted with respect to the sheet out of contact with the tongue. Pivoting the tongue and prongs breaks the tongue and groove connection of the hanger momentarily so that a hook end of a product package can be inserted therebetween. Releasing the tongue and prongs allows them to capture the hook and suspend the product. The product is retained to the strip securely, so it will not readily fall out if the strip is tipped or dropped, until it is pulled free from the hanger. The hangers can be arranged in spaced apart columns and staggered such that one column is closer to the top end and an adjacent column is closer to the bottom end so that overlapped products are more readily removable.

In another preferred form, the hangers are formed of slits defining tongues with round-headed free ends. Preferably, the tongues are hinged to the sheet at a proximal end and the tongues neck down to an enlarged round head at the free end (resembling a sideways keyhole). The neck and enlarged head help retain the hook or other hanger of the product and the round shape of the head prevents the product for snagging when installed or removed. In this hanger configuration, preferably the hangers are arranged on the strip in pairs, the hangers of the individual pairs being in opposite orientations and spaced apart in the direction between the top and bottom of the strip. The pairs of hangers are also arranged in staggered longitudinal (vertical) columns.

In still another preferred form, the hangers are formed of slits defining tongues with upwardly extending (90 degree angle) hooked free ends. The tongues are hinged to the sheet at the proximal end and have an intermediate lateral section with a serrated upper edge. The serrated edge provides valleys in which an edge of the product hanger can seat, and the free ends extend longitudinally perpendicular to the serrated section so that the products cannot slide straight off of the free end of the hanger. Like the preceding hanger configuration, here the hangers can be arranged on the strip in pairs, with the hangers of the individual pairs being in opposite orientations and spaced apart in the direction between the top and bottom of the strip so that each hinged proximal end lies essentially along the same longitudinal (vertical) axis.

For any of the above hanger configurations, the hanger strip can include a mounting feature, for example, which can be a simple hole through the top end of the strip for fitting onto a clip or post. Also, the sheet preferably defines a display area devoid of hangers that is printed on or receives decals associated with the products being displayed.

For any of the above hanger configurations, the hanger strip can include a mounting feature, for example, which can be a simple hole through the top end of the strip for fitting onto a clip or post. Also, the sheet preferably defines a display area devoid of hangers that is printed on or receives decals associated with the products being displayed.

The present invention thus provides a point of purchase display with a hanger display strip with an improved lateral tongue and groove connection. The lateral orientation of the tongues better retains the products to the strip while allowing products to be removed therefrom by simply pulling the product straight away from the strip (to spread apart the tongue and prongs), and thereby make it easier to remove one product at a time without inadvertently dislodging adjacent products. In addition, each of the hangers can be pivoted to either the front or back side of the strip, which allows for products to be anchored at either or both sides of the strip. Thus, the hanger strip of the present invention could be used for one-sided display or two-sided display. Moreover, the strip could be used to display the same product at both sides, or it could be printed to display one product at its front and a different product at its back.

The advantages of the invention will appear from the following description. In this description, reference is made to the accompanying drawings which form a part hereof and in which there is shown by way of illustration preferred embodiments of the invention. These embodiments do not represent the full scope of the invention. Thus, the claims should be looked to in order to ascertain the scope of the invention.

DESCRIPTION OF THE DRAWINGS

These and other advantages of the present invention are best understood with reference to the drawings, in which.

DETAILED DESCRIPTION OF THE EXEMPLARY EMBODIMENTS

Figure 1:
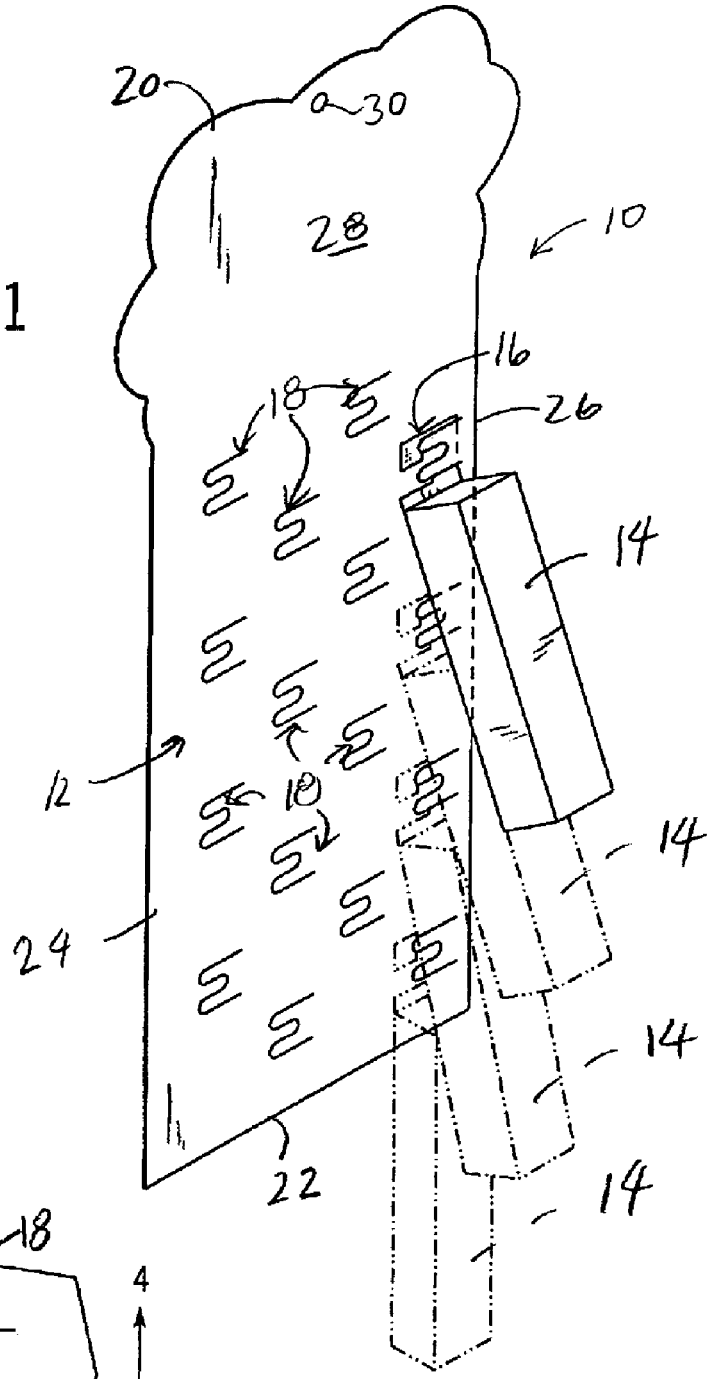
FIG. 1 is front perspective view of the product display hanger strip according to the present invention, showing products hanging thereon.

A point of purchase display 10 according to the present invention is shown in one preferred form in FIG. 1. Generally, the display 10 includes a hanger strip 12 and a plurality of hangable products 14 in which either the products or the product packages (as shown) have a hook feature 16 that engages with one of a plurality of hangers 18 formed in the hanger strip 12.

Figure 2:
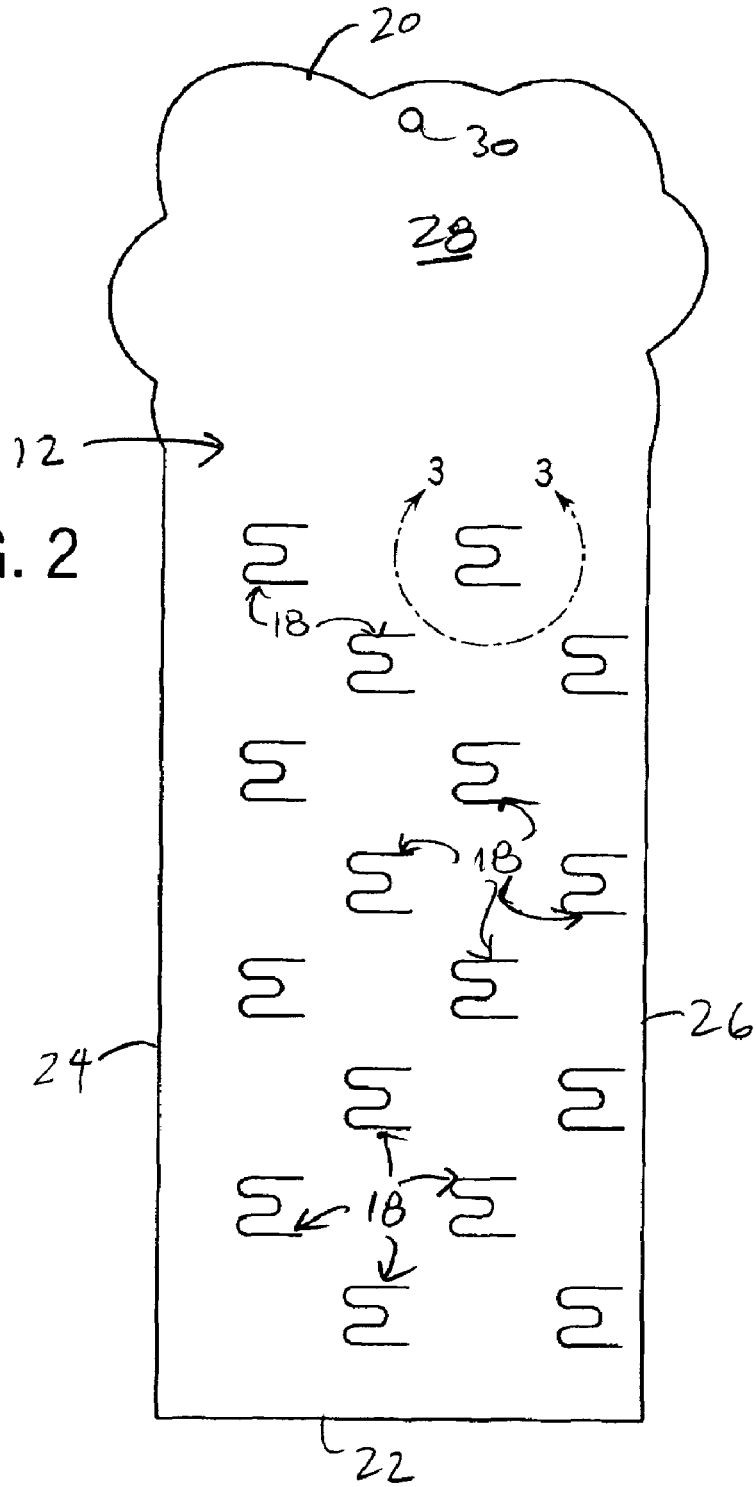
FIG. 2 is a front plan view of the hanger strip of FIG. 1.

More specifically, with reference to FIG. 2, the hanger strip 12 is of single sheet construction, preferably made of somewhat flexible paperboard or plastic sheeting. The hanger strip 12 has a top end 20, a bottom end 22, and opposite sides 24 and 26. The hanger strip 12 is shown as be longer from top to bottom than from side to side, however, this need not be the case. Preferably, the hanger strip 12 has a display area 28 devoid of hangers where printing or decals can be placed containing text and graphics promoting the associated products. Also, preferably, the hanger strip 12 includes some type of mounting feature, which in one form can be a simple hole 30 for suspending the hanger strip 12 from a clip, nail or other post like element. Such a mounting feature should be located at the top end 20 of the hanger strip 12 to allow it to hang plumb. Other mounting features, such as adhesives, magnets, or clips, can be attached at any suitable location, such as at the back side of the sheet slightly above center.

The hangers 18 are formed in the hanger strip 12 by a punch cut technique forming multiple slits therein without removing material. As shown in the drawings, the slits are continuous between their unconnected ends and generally form a curving "E" shape. Of course, the hangers 18 could be formed by discontinuous cuts or with slits having squared corners or opposite orientations (forming backwards "E" shapes). These variations notwithstanding, the slits must form hangers 18 that extend laterally, that is in the direction between the sides 24 and 26. In particular, the E-shaped slits define opposing tongue and groove features, having a tongue 32 extending in one lateral direction to a free end 34 disposed in a groove 36 formed between two prongs 38 having free ends 40 extending in the opposite lateral direction above and below the tongue 32. Since the tongue 32 and prongs 38 are unitary parts of the sheet, but have free ends 34 and 40, respectively, they can be pivoted out of contact with each other in the fashion of window shutters. Doing so disengages the tongue and groove connection so that the products can be attached to and removed from the hangers 18. While not necessary, the hangers 18 can be arranged in spaced apart columns for an orderly appearance and the columns can be staggered between the top 20 and bottom 22 ends so that the ends of the products 14 in adjacent columns are not aligned horizontally, which also improves the appearance of the display and can aid in removing a single product without dislodging others.

Figure 3:
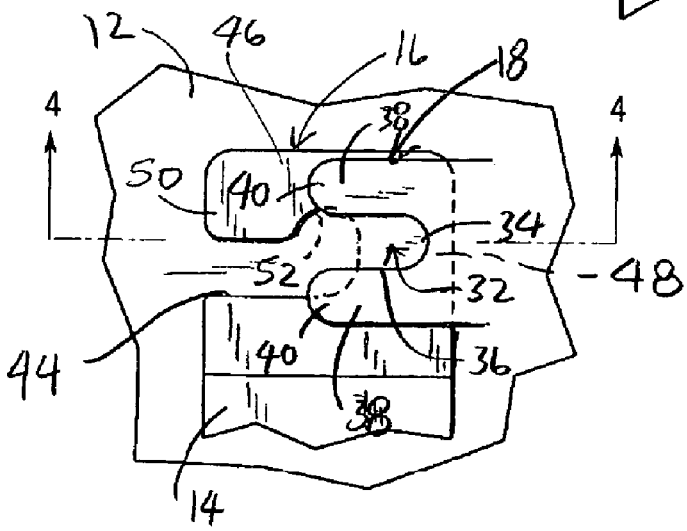
FIG. 3 is an enlarged partial front view taken along arc 3-3 of FIG. 2 of one lateral hanger feature of the hanger display strip of FIG. 1 with a hanger end of product package shown engaged therein.
Figure 4:
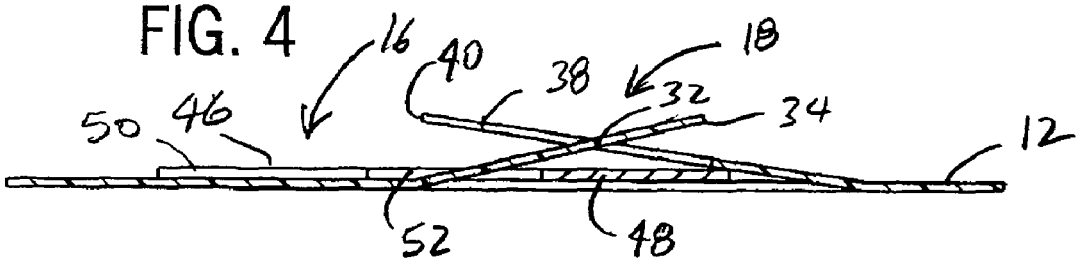
FIG. 4 is a cross-sectional view taken along line 4-4 of FIG. 3.

As shown in FIGS. 3 and 4, the hangers 18 engage each of the products 14 at the hook feature 16. The hook feature 16 can be unitary part of the product or its packaging or it can be simply a tab attached thereto, for example, by an adhesive. In any event, the hook feature 16 has a laterally extending opening or slot 44 (in this case opening to the left as shown in FIG. 3) to define a hook 46 having a neck 48 and a free end 50. An inner portion 52 of the slot 44 is larger, preferably just slightly larger, than the height of the tongue 32. The gap adjacent the free end 50, on the other hand, is smaller than the height of the tongue 32 so that it can wrap around the tongue 32.

In particular, when the product 14 is mounted in the hanger 16 (as shown in FIGS. 3 and 4) by pivoting the tongue 32 and prongs 38 to the front side of the hanger strip 12, the neck 48 of the hook 46 can fit through the gap between the tongue 32 and prongs 38 and the free end 50 of the hook 46 can fit over the tongue 32, which fits through the inner portion 52 of the slot 44. Releasing the tongue 32 and prongs 38 allows them to flex back toward their original position (although not completely due to the presence of the hook 46 as shown in FIG. 4). In this way, the neck 48 of the hook 46 is captured between the tongue and groove connection at a back side of the tongue 32 while the free end 50 of the hook 46 overlaps a front side of the tongue 32. This arrangement securely retains the product in the hanger strip 12 since the hook 46 is supported by the laterally extending tongue 32 with its neck 48 captured behind the tongue 32 and prongs 38. The products 14 are thus more apt to stay connected to the hanger strip 12 in the event it is tipped or falls from its mount and when one product is removed. Despite this improved connection, each product 14 can be simply pulled free from the hanger strip 12 in which case the hook 46 and/or the tongue 32 and prongs 38 will flex and disengage. The lateral arrangement of the hangers 18 permit the products 14 to be removed by pulling them straight (or at angle) out from the hanger strip 12, rather than sliding it up and interfering with an adjacent product.

FIGS. 5-7 and 8-10 illustrate two alternate product display hanger strips according to the present invention. These two alternate embodiments are similar to the above described embodiment and thus similar reference numerals will be used were appropriate, albeit with the suffix "A" for the embodiment in FIGS. 5-7 and the suffix "B" for the embodiment in FIGS. 8-10. Both alternate embodiments differ from the previously described embodiment primarily in the configuration of the hangers on the hanger strip.

Figure 5:
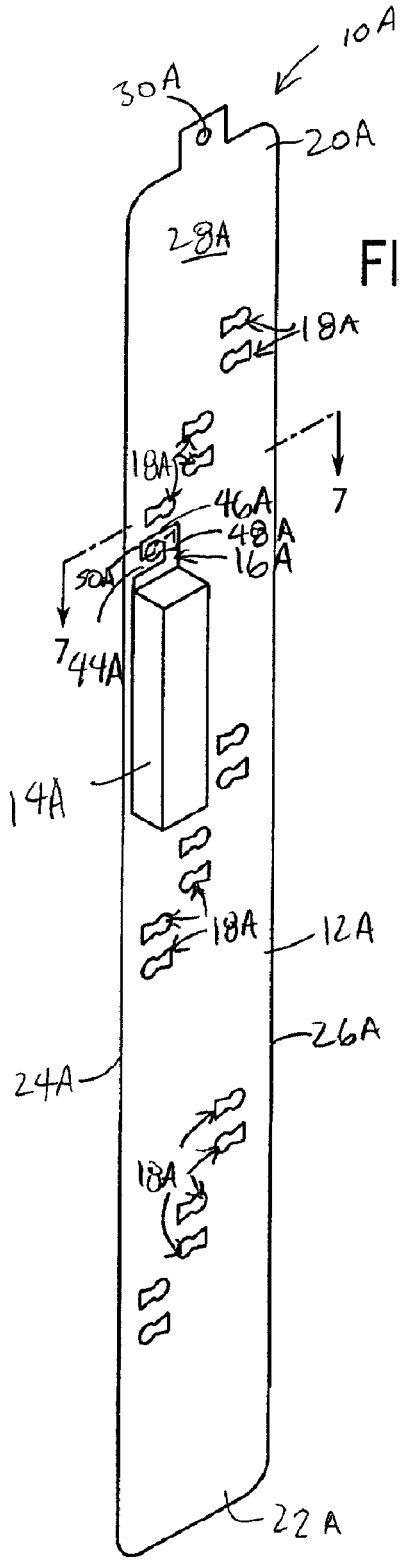
FIG. 5 is a perspective view of an alternate embodiment of the product display hanger strip having sideways hangers of a different configuration.
Figure 6:
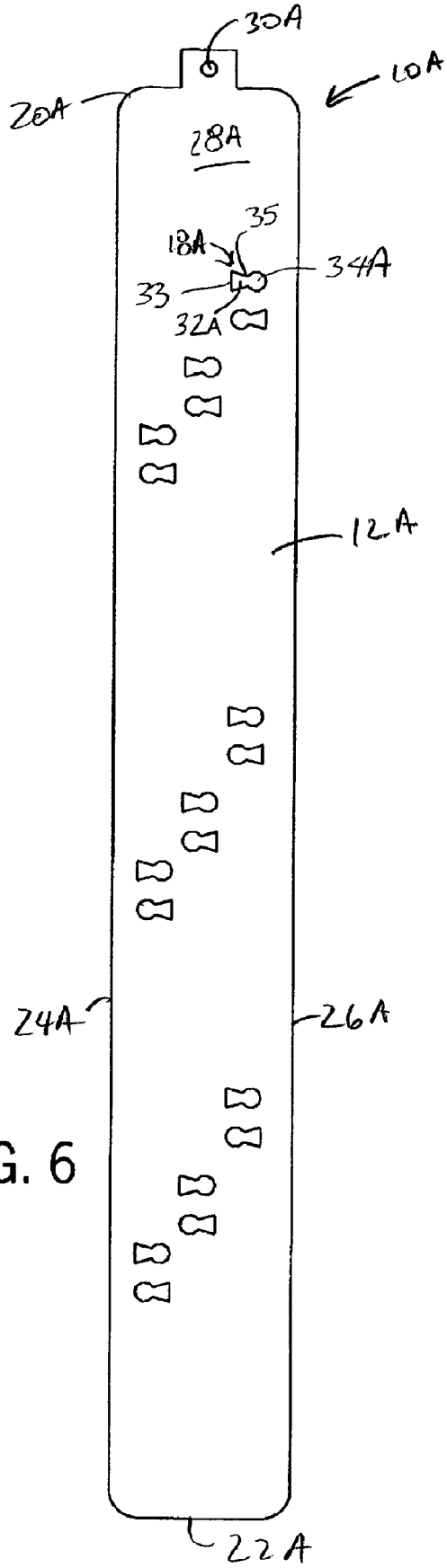
FIG. 6 is a front plan view thereof.
Figure 7:
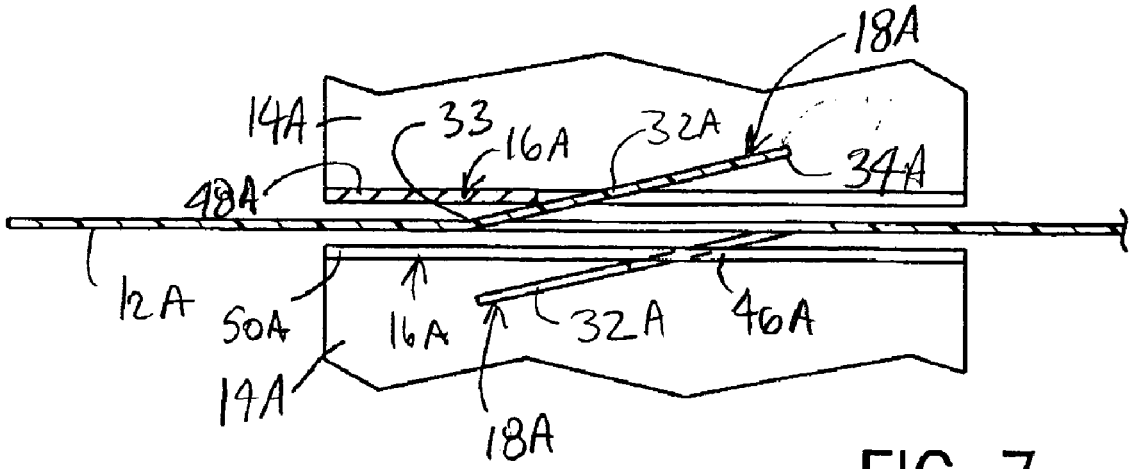
FIG. 7 is a partial cross-sectional view taken along line 7-7 of FIG. 5.

In particular, referring to FIGS. 5-7, a point of purchase display 10A includes a hanger strip 12A and a plurality of hangable products 14A having a hanger feature 16A that engages with one of a plurality of hangers 18A formed in the hanger strip 12A. As before, the hanger strip 12A is of single sheet flexible paperboard or plastic having a top end 20A, a bottom end 22A, opposite sides 24A and 26A and a display area 28A with a mounting hole 30A. Slits are cut into the strip sheet to form the hangers 18A. As shown in the drawings, each slit is continuous between unconnected ends and generally forms a tongue 32A, which extends laterally in the direction between the sides 24A and 26A. In particular, each tongue 32A is hinged to the sheet at a proximal end 33 and narrows to a neck 35 before enlarged to a round-headed free end 34A. The free ends 34A can be pivoted away from the plane of the hanger strip sheet toward either a front side or a back side thereof so that the products can be attached to and removed from the hangers 18A. In this configuration, the hangers 18A are preferably arranged in pairs, the hangers 18A of the individual pairs being in opposite orientations and spaced apart in the direction between the top and bottom of the strip. The pairs of hangers 18A are also arranged in staggered longitudinal (vertical) columns, as shown. This gives the display an orderly appearance and staggers the products 14 in adjacent columns so that their ends are not aligned horizontally, thereby making it easier to remove a single product without dislodging others.

Preferably, the hangers 18A are engaged by the hanger feature 16A of the products 14A, which is either part of the product itself or its packaging. For this embodiment, the hanger feature 16A is preferably a hook with a laterally extending opening or slot 44A (in this case opening to the left as shown in FIG. 5) to define a hook 46A having a neck 48A and a free end 50A. Although not shown, an inner portion of the slot 44A can be larger than the height of the tongue 32A while the gap adjacent the free end 50A is smaller than the height of the tongue 32A so that it can wrap around the tongue 32A. This is shown clearly in FIG. 3 of the first described embodiment.

When a product 14A is mounted in the hanger 16A (as shown in FIGS. 5 and 7) by pivoting the tongue 32A to one side of the hanger strip 12A, the neck 48A of the hook 46A can fit through the gap between the tongue 32A and the hanger strip 12A and the free end 50A of the hook 46A can fit over the tongue 32, which fits through the inner portion 52 of the slot 44, and rest in the valley of the neck portion adjacent the rounded head at the free end, thus helping to better retain the product 14A to the hanger 12A. The round shape of the free end 34A reduces the chance that the products will get caught up when sliding them onto or off of the hanger 12A.

Figure 10:
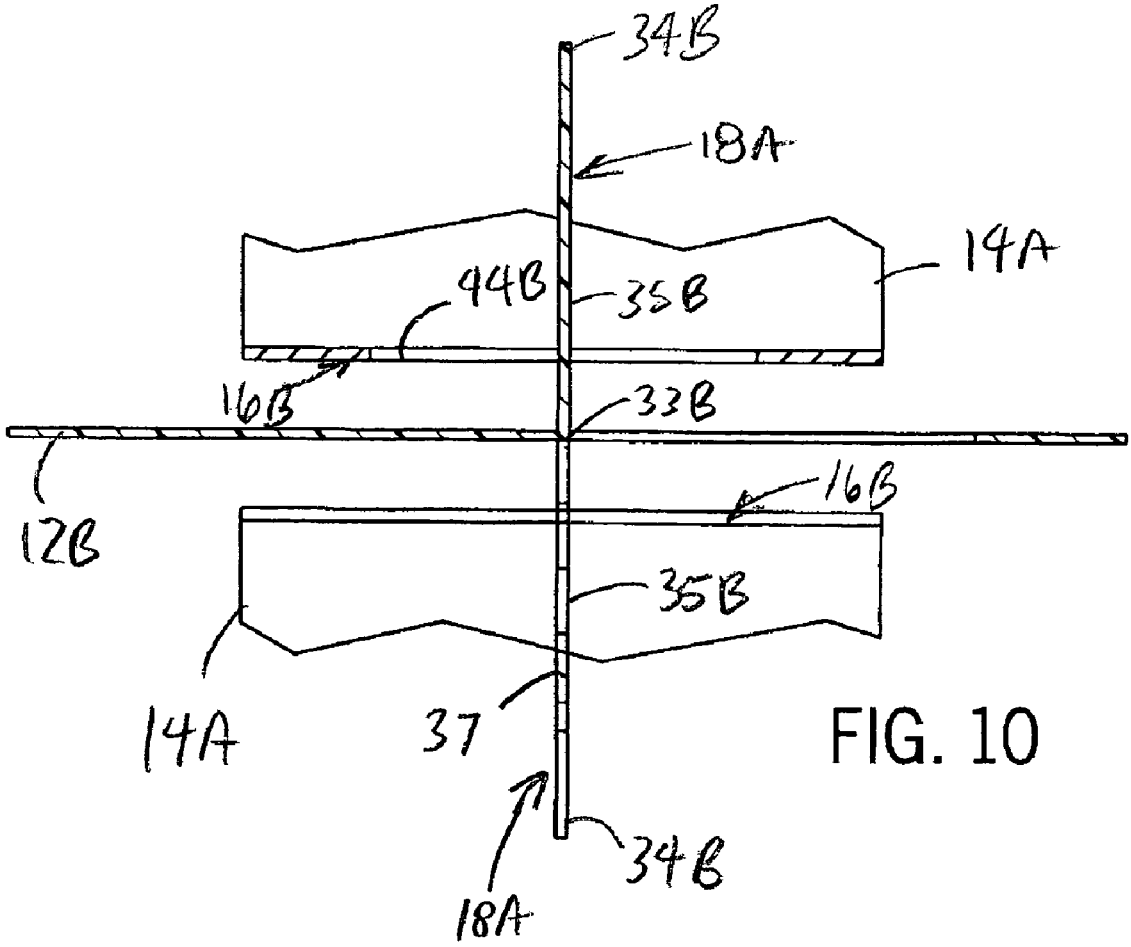
FIG. 10 is a partial cross-sectional view taken along line 10-10 of FIG. 8.
Figure 8:
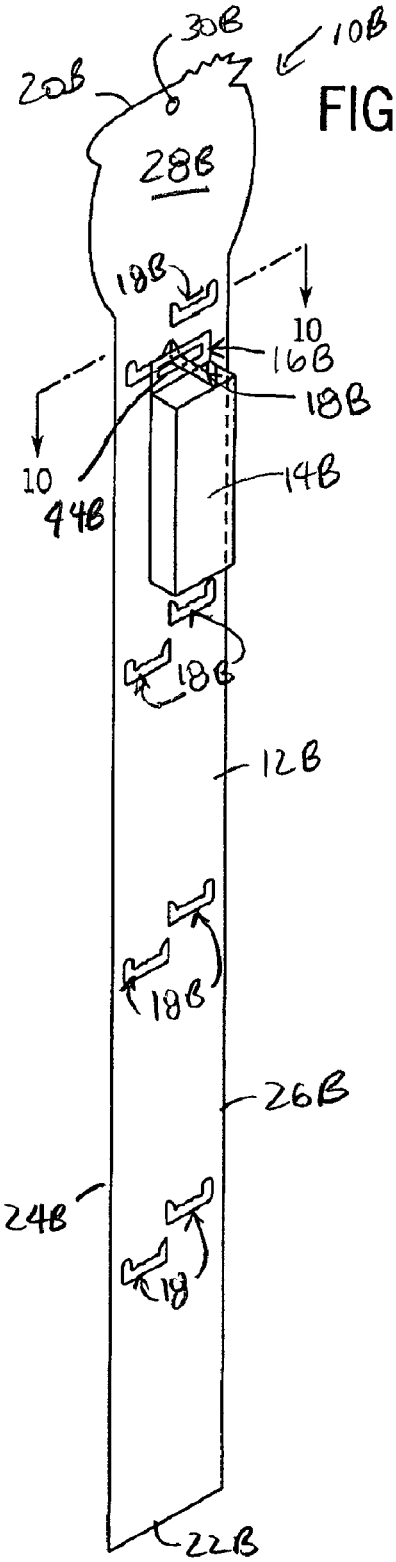
FIG. 8 is a perspective view of another alternate embodiment of the product display hanger strip having sideways hangers with serrated edges and hooked ends.
Figure 9:
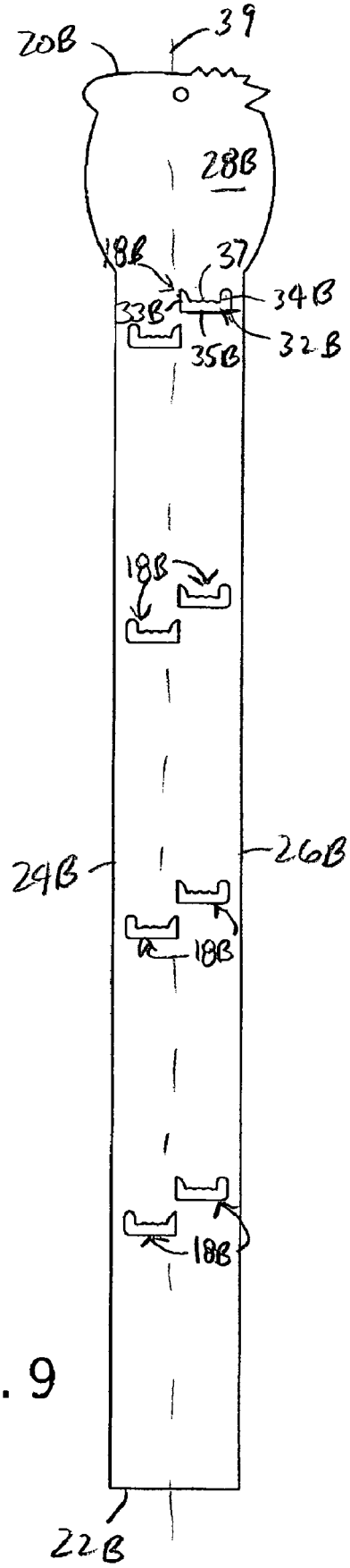
FIG. 9 is a front plan view thereof.

With regard to the embodiment shown in FIGS. 8-10, a point of purchase display 10B includes a hanger strip 12B and a plurality of hangable products 14B having a hanger feature 16B that engages one of a plurality of hangers 18B formed in the hanger strip 12B. Again, the hanger strip 12B has a top end 20B, a bottom end 22B, opposite sides 24B and 26B and a display area 28B with a mounting hole 30B. Slits are cut into the strip sheet to form the hangers 18B to be continuous between unconnected ends and form a tongue 32B, which extends laterally in the direction between the sides 24B and 26B. In particular, each tongue 32B is hinged to the sheet at a proximal end 33B and extends through an intermediate section 35B having a serrated top edge 37 leading to an upright hooked free end 34B perpendicular to the intermediate section 35B. The free ends 34A can be pivoted away from the plane of the hanger strip sheet toward either the front or back side thereof so that the products can be attached to and removed from the hangers 18B. Like in the preceding embodiment, here the hangers 18B can be arranged on the strip in pairs, with the hangers 12B of the individual pairs being in opposite orientations and spaced apart in the direction between the top and bottom of the hanger strip 12B so that each hinged proximal end 33B lies essentially along the same longitudinal (vertical) axis 39. Like the above-described embodiments, this gives the display an orderly appearance and staggers the products 14 in adjacent columns so that their ends are not aligned horizontally, thereby making it easier to remove a single product without dislodging others.

Preferably, the hangers 18B are engaged by the hanger feature 16B of the products 14B, which is either part of the product itself or its packaging. For this embodiment, the hanger feature 16B is preferably a bounded (no open ends) opening 44B, either being a circular opening or a laterally extending opening (as shown in FIG. 8).

When one of the products 14B is mounted in the hanger 16B (as shown in FIGS. 8 and 10) by pivoting the tongue 32B to one side of the hanger strip 12B, opening 44B simply slips over the free end 34B of the tongue 32B and rests in a valley of the serrated edge 39, which helps retain the product 14B to the hanger 12B. The product 14B is further retained on the hanger 18B because the hooked free end 34B, being longer than the height of the opening 44B, will engage the product 14B if it were to attempt to slide off of the tongue 32B (for example if the display where to tip over).

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A point of purchase display configured to display a plurality of retail products, the point of purchase display comprising:

a product display hanger strip comprising:

a flexible, single planar sheet constructed from one of a paperboard and a plastic material, said planar sheet extending from a top end to a bottom end, having opposite front and back surfaces, and having opposite side edges extending between said top and bottom ends thereof; and a plurality of display hangers each of which is formed integrally in said sheet by a slit, said display hangers being aligned in at least one column from said top end to said bottom end of said sheet, each column having at least one pair of display hangers contained therein;

wherein said display hangers are each integrally connected to said sheet at a hinge point and extend laterally essentially perpendicular to a direction between said top and bottom ends of said sheet; and wherein each of said display hangers has a distal end opposite said hinge point, said distal end of each of said display hangers having a first position in which it extends away from said front surface of said sheet and a second position in which it extends away from said rear surface of said sheet and being configurable between said first position and said second position, and wherein each of said display hangers can be pivoted to extend away from either said front surface or said back surface of said sheet; and a plurality of product hangers each having a single retail product supported therefrom, each of said product hangers configured to engage and be securely retained by one of said display hangers of said product display hanger strip to support the single retail product supported from said product hanger.

2. A point of purchase display as defined in claim 1, wherein each product hanger has an opening sized to receive the distal end of one of said display hangers of said product display hanger strip therein.

3. A point of purchase display as defined in claim 1, wherein said display hangers are arranged in at least two staggered, spaced-apart columns.

4. A point of purchase display as defined in claim 1, additionally comprising:

a mounting mechanism located at said top end of said sheet for suspending said product display hanger strip; and a display area devoid of hangers.

5. A point of purchase display as defined in claim 1, wherein said display hangers are arranged in spaced-apart columns, said columns being staggered such that one of said columns is closer to said top end of said sheet and a second one of said columns is closer to said bottom end of said sheet.

6. A point of purchase display as defined in claim 1, wherein said display hangers are arranged in spaced-apart columns, said columns being staggered such that one of said columns is closer to one of said side edges of said sheet and a second one of said columns is closer to the other of said side edges of said sheet.

7. A point of purchase display as defined in claim 1, wherein said display hangers are arranged in pairs and in each of said pairs of display hangers said display hangers are spaced apart in the direction between said top and bottom ends of said sheet and oriented so that said distal ends of said display hangers ends extend toward opposite side edges of said sheet.

8. A point of purchase display as defined in claim 7, wherein said pairs of display hangers are aligned about a longitudinal axis extending between said top and bottom ends of said sheet with each of said display hangers having said proximal end disposed essentially along said longitudinal axis.

9. A point of purchase display as defined in claim 1, wherein said distal ends of each of said display hangers comprises a product retaining element.

10. A point of purchase display as defined in claim 1, wherein each of said product hangers comprises a bounded opening.

11. A point of purchase display as defined in claim 1, wherein each of said display hangers includes an enlarged head section at said distal end.

12. A point of purchase display as defined in claim 1, wherein each of said display hangers includes a hook section at said distal end.

13. A point of purchase display, comprising:

a product display hanger strip comprising:

a single flexible planar sheet constructed from one of a paperboard and a plastic material, the planar sheet extending from a top end to a bottom end, having opposite front and back surfaces, and having opposite side edges extending between said top and bottom ends thereof; and a first plurality of display hangers each of which is formed integrally in said sheet by a slit, wherein said first plurality of display hangers are each integrally connected to said sheet at a hinge point and extend laterally essentially perpendicular to a direction between said top and bottom ends of said sheet, said first plurality of display hangers being formed in a first, substantially vertical column; and a second plurality of display hangers each of which is formed integrally in said sheet by a slit, wherein said second plurality of display hangers are each integrally connected to said sheet at a hinge point and extend laterally essentially perpendicular to the direction between said top and bottom ends of said sheet, said second plurality of display hangers formed in a second, substantially vertical column, each of the first and second vertical columns including at least two display hangers; and wherein each of said display hangers in said first and second pluralities has a distal end opposite said hinge point, each of said distal end having a first position in which it extends away from said front surface of said sheet and a second position in which it extends away from said rear surface of said sheet and being configurable between said first position and said second position, and whereby said distal end of each of said display hangers can be pivoted out away with respect to said sheet to extend from either said front surface or said back surface of said sheet;

a plurality of product hangers each having a single retail product supported therefrom, each of said product hangers configured to engage and be securely retained by one of said display hangers of said product display hanger strip to support the single retail product supported from said product hanger.

14. A point of purchase display as defined in claim 13, wherein said display hangers are arranged in at least two staggered, spaced-apart columns.

15. A point of purchase display as defined in claim 13, wherein each product hanger has an opening sized to receive the distal end of one of said display hangers of said product display hanger strip therein.

16. A point of purchase display as defined in claim 13, wherein said distal ends of each of said display hangers comprises a product retaining element.

17. A point of purchase display, comprising:

a product display hanger strip comprising:

a flexible planar sheet having a top end and a bottom end, opposite front and back surfaces, and opposite side edges extending between said top and bottom ends thereof; and a plurality of display hangers each of which is formed integrally in said sheet by a slit, said display hangers being arranged in said sheet in a plurality of adjacent, spaced-apart pairs of said display hangers;

wherein said display hangers are each integrally connected to said sheet at a hinge point and extend laterally essentially perpendicular to a direction between said top and bottom ends of said sheet; and wherein each of said display hangers has a distal end opposite said hinge point, said distal end of each of said display hangers being repetitively pivotable between a first position in which it extends away from said front surface of said sheet and a second position in which it extends away from said rear surface of said sheet and being configurable between said first position and said second position, and wherein each of said pairs of said display hangers can have one display hanger pivoted to extend away from said front surface and the other of said display hangers pivoted to extend away from said back surface of said sheet; and a plurality of product hangers each having a single retail product supported therefrom, each of said product hangers configured to engage and be securely retained by one of said display hangers of said product display hanger strip to support the single retail product supported from said product hanger.

18. A point of purchase display as defined in claim 17, wherein each product hanger has an opening sized to receive the distal end of one of said display hangers of said product display hanger strip therein.

19. A point of purchase display as defined in claim 17, wherein each of said adjacent, spaced-apart pairs of said display hangers are respectively located above and below each other, and wherein said hinge point and said distal end of one of said display hangers in each pair are located either respectively above or below said distal end and said hinge point of the other of said display hangers in each pair, respectively.

20. A point of purchase display as defined in claim 17, wherein each of said adjacent, spaced-apart pairs of said display hangers are respectively located above and below each other, and wherein said hinge points of said display hangers in each pair are respectively located above or below each other.

* * * * *